US011262684B2

(12) United States Patent
Ikegami et al.

(10) Patent No.: US 11,262,684 B2
(45) Date of Patent: Mar. 1, 2022

(54) IMAGE FORMING APPARATUS HAVING A FLAP SWINGABLE FROM A FIRST POSITION TO A SECOND POSITION

(71) Applicant: BROTHER KOGYO KABUSHIKI KAISHA, Nagoya (JP)

(72) Inventors: Yusuke Ikegami, Nagoya (JP); Kazuya Kamikawa, Nagakute (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 121 days.

(21) Appl. No.: 16/725,225

(22) Filed: Dec. 23, 2019

(65) Prior Publication Data

US 2020/0209797 A1 Jul. 2, 2020

(30) Foreign Application Priority Data

Dec. 26, 2018 (JP) ..... JP2018-243556

(51) Int. Cl.
*G03G 15/00* (2006.01)
*B65H 29/12* (2006.01)
*B65H 29/60* (2006.01)

(52) U.S. Cl.
CPC ..... *G03G 15/6529* (2013.01); *B65H 29/12* (2013.01); *B65H 29/60* (2013.01); *G03G 15/6552* (2013.01)

(58) Field of Classification Search
USPC ..... 399/328
See application file for complete search history.

(56) References Cited

U.S. PATENT DOCUMENTS 6,179,287 B1 * 1/2001 Watanabe ..... B65H 33/10 270/52.03
8,676,111 B2 * 3/2014 Aoi ..... G03G 15/235 399/397
9,568,871 B2 * 2/2017 Fukase ..... G03G 21/1647
2007/0048055 A1 3/2007 Ishikuro
2008/0251991 A1 * 10/2008 Doyo ..... B65H 5/062 271/109
2010/0034559 A1 * 2/2010 Sahara ..... G03G 21/1685 399/122

(Continued)

FOREIGN PATENT DOCUMENTS

JP 2002-145504 A 5/2002
JP 4748661 B2 8/2011
JP 2016-071224 A 5/2016

*Primary Examiner* — Quana Grainger
(74) *Attorney, Agent, or Firm* — Baker Botts L.L.P.

(57) ABSTRACT

A first transport unit transports, along a first path, a sheet transported from an image forming unit. A second transport unit transports the sheet along a second transport path branched from a junction with the first transport path. A first cover, when open, holds the sheet transported to an exterior of a housing and, when closed, partially constitutes the second transport unit. A flap is disposed at the junction and, when at a first position, blocks the second transport path and guides the sheet along the first transport path and, when at a second position, blocks the first transport path and guides the sheet along the second transport path. A drive unit moves the flap between the first position and the second position. A moving mechanism moves away from the flap in response to closing of the first cover, and pushes and moves the flap to the second position.

20 Claims, 11 Drawing Sheets

(56) References Cited

U.S. PATENT DOCUMENTS

| | | | | |
|---|---|---|---|---|
| 2010/0247146 | A1* | 9/2010 | Takeuchi | G03G 21/1633 399/124 |
| 2015/0274469 | A1 | 10/2015 | Mori et al. | |
| 2018/0127228 | A1* | 5/2018 | Nakayashiki | B65H 29/52 |

* cited by examiner

IMAGE FORMING APPARATUS HAVING A FLAP SWINGABLE FROM A FIRST POSITION TO A SECOND POSITION

CROSS-REFERENCE TO RELATED APPLICATION

This application claims priority from Japanese Patent Application No. 2018-243556 filed on Dec. 26, 2018, the content of which is incorporated herein by reference in its entirety.

TECHNICAL FIELD

Aspects of the disclosure relate to an image forming apparatus configured to form an image on both sides of a sheet.

BACKGROUND

A known image forming apparatus capable of duplex image forming has a main transport path for transporting a sheet transported from an image forming unit, a first discharge path for discharging the sheet transported from the main transport path to a discharge tray at an upper portion of a housing, and a return path branched from the main transport path for transporting the sheet upward and switching back the sheet, and then transporting the sheet downward back to the image forming unit.

The return path for inverting a sheet, which is provided separately from the first discharge path, allows the known image forming apparatus to form images on both sides of sheets at higher speed than an image forming apparatus having a single path for discharging and inverting a sheet.

SUMMARY

A known image forming apparatus has, in addition to a facedown discharge path for discharging a sheet with an image-recorded surface facing down onto a discharge tray, a straight discharge path for discharging straight a sheet transported from an image forming unit to an exterior of a housing. In this case, a curled sheet to be discharged straight may erroneously enter the facedown discharge path.

Aspects of the disclosure provide an image forming apparatus configured to discharge a sheet straight properly while preventing or reducing entry of a sheet into a first transport path leading to a discharge tray or into a second transport path branched from the first transport path.

According to one or more aspects of the disclosure, an image forming apparatus includes an image forming unit configured to form an image on a sheet, a housing, a first transport unit, a second transport unit, a first cover, a flap, a drive unit, and a moving mechanism. The housing stores therein the image forming unit, includes a discharge tray at an upper portion thereof, and has a particular end. The first transport unit is configured to transport, along a first transport path, the sheet transported from the image forming unit to the discharge tray. The second transport unit is configured to transport, along a second transport path, the sheet transported from the image forming unit. The second transport path is branched from a junction with the first transport path and extends upward at a position closer to the particular end of the housing than the first transport path. The first cover is disposed at the particular end of the housing pivotably relative to the housing and configured to, when closed, at least partially constitute the second transport unit and, when open, hold the sheet transported from the image forming unit to the exterior of the housing. The flap is disposed at the junction and swingable between a first position and a second position. The flap is configured to, when at the first position, block the second transport path and guide, along the first transport path, the sheet transported from the image forming unit and, when at the second position, block the first transport path and guide, along the second transport path, the sheet transported from the image forming unit. The drive unit is configured to move the flap between the first position and the second position. The moving mechanism is configured to, in response to closing of the first cover, move away from the flap and, in response to opening of the first cover, push and move the flap to the second position.

BRIEF DESCRIPTION OF THE DRAWINGS

Aspects of the disclosure are illustrated by way of example and not by limitation in the accompanying figures in which like reference characters indicate similar elements.

DETAILED DESCRIPTION

An illustrative embodiment of the disclosure will be described with reference to the accompanying drawings.

Overall Structure of Image Forming Apparatus

Figure 1:
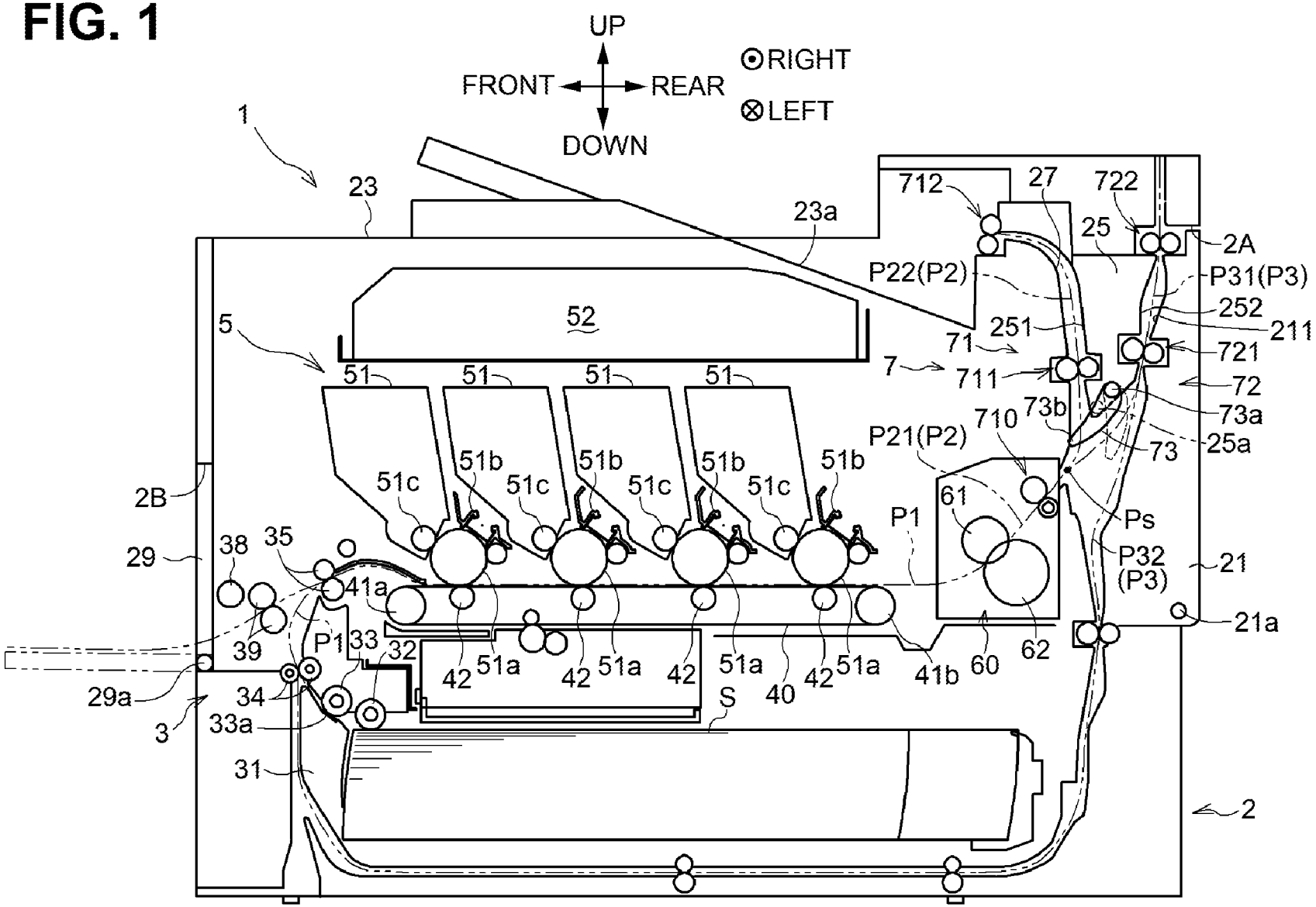
FIG. 1 is a central cross-sectional view of an image forming apparatus according to an illustrative embodiment of the disclosure.
Figure 2:
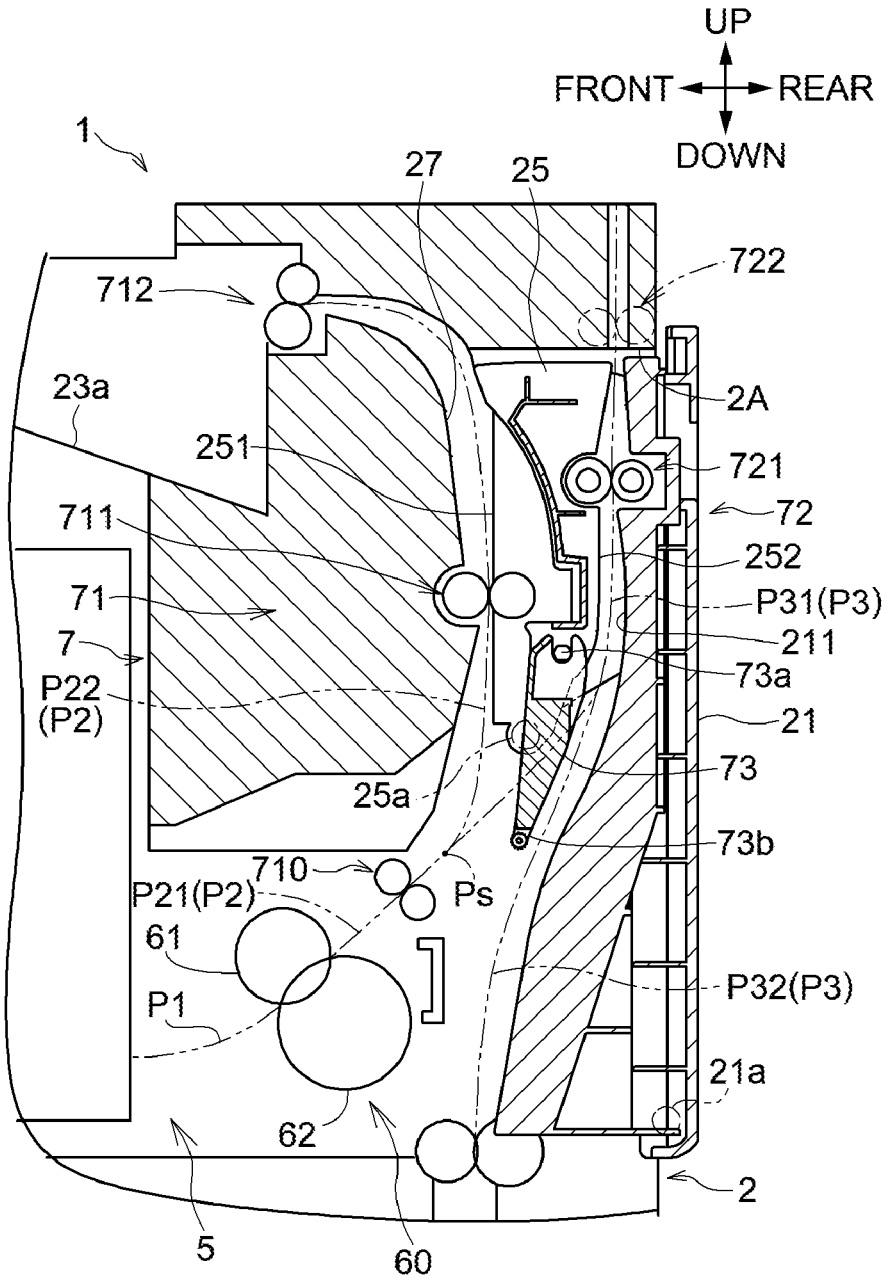
FIG. 2 is a cross-sectional side view of a transport unit of the image forming apparatus, with a rear cover closed and a flap located at a first position.

As shown in FIG. 1, an image forming apparatus according to an embodiment of the disclosure is an electrophotographic color laser printer for forming an image on a sheet S, such as a paper sheet and a transparency, by overlapping developing agent images of different colors. The image forming apparatus may be a monochrome laser printer for forming a monochrome developing agent image on a sheet.

In the following description, left and right sides of the page of FIG. 1, a side facing out of the page, and a side facing into the page are defined respectively as front, rear, left, and right sides of the image forming apparatus 1. Upper and lower sides of the page of FIG. 1 are defined respectively as upper and lower sides of the image forming apparatus 1.

The image forming apparatus 1 includes a housing 2, a feeder 3 configured to feed a sheet S, an image forming unit 5 configured to form an image on the sheet S, and a transport unit 7 configured to transport the sheet S transported from the image forming unit 5.

The housing 2 is a box having a substantially rectangular parallelepiped shape and stores therein the feeder 3, the image forming unit 5, and the transport unit 7. The housing 2 includes a first opening 2A open rearward, and a rear cover 21 openable and closable relative to the first opening 2A. In other words, the rear cover 21 is disposed at a rear end of the housing 2. The rear cover 21 is an example of a first cover.

The rear cover 21 has a first pivot shaft or axis 21*a* located at its lower end and extending in the left-right direction. The rear cover 21 is pivotable about the first pivot axis 21*a* to be opened and closed relative to the housing 2. The first opening 2A is exposed when the rear cover 21 is open, and is covered when the rear cover 21 is closed. A top cover 23 covers an upper portion of the housing 2. The upper cover 23 includes a discharge tray 23*a* inclined downward from the front toward the rear so as to be recessed. In other words, the housing 2 includes, at its upper portion, the discharge tray 23*a*.

The feeder 3 includes a sheet cassette 31, a first feed roller 32, a separation roller 33, a separation pad 33*a*, a first transport roller pair 34, and a registration roller pair 35. The housing 2 defines therein a main transport path P1 for transporting a sheet S from the sheet cassette 31 via the image forming unit 5.

The sheet cassette 31 supports a stack of sheets S. The first feed roller 32, the separation roller 33, and the separation pad 33*a* feeds one sheet S at a time from the sheet cassette 31 into the main transport path P1. The transport rollers 34 and the registration rollers 35 transport the sheet S fed into the main transport path P1 toward the image forming unit 5.

The housing 2 includes a second opening 2B open frontward, and a front cover 29 openable and closable relative to the second opening 2B. The front cover 29 has, at its lower end, a third pivot shaft or axis 29*a* extending in the left-right direction. The front cover 29 is pivotable about the third pivot axis 29*a* to be opened and closed relative to the housing 2. The second opening 2B is exposed when the front cover 29 is open, and covered when the front cover 29 is closed.

The feeder 3 includes a second feed roller 38 and a second transport roller pair 39. In a state where the front cover 29 is open, the second feed roller 38 moves down and feeds one of the sheets S placed on the front cover 29, and the second transport rollers 39 transport the sheet S into the main transport path P1. The registration rollers 35 transport the sheet S fed into the main transport path P1 toward the image forming unit 5.

The image forming unit 5 is disposed above the feeder 3 and includes four drum units 51 arranged in tandem in the front-rear direction. Each drum unit 51 corresponds to one of colors: black, yellow, magenta, and cyan. Each drum unit 51 includes a photosensitive drum 51*a*, a charger 51*b*, and a developing roller 51*c*.

The image forming unit 5 includes a scanner 52 and a fixer 60. The scanner 52 is disposed at an upper portion in the housing 2 and irradiates each photosensitive drum 51 based on image data by scanning at high speed a laser beam over its surface, via a polygon mirror, lenses, and reflection mirrors. The fixer 60 is disposed downstream of the most downstream one of the photosensitive drums 51*a* in a sheet transport direction.

A transfer belt 40 is disposed below the image forming unit 5 to define the main transport path P1 therebetween. The transfer belt 40 is stretched between a drive roller 41*a* and a driven roller 41*b* which is disposed further to the rear of the housing 2 than the drive roller 41*a*. A transfer roller 42 is disposed opposite to each photosensitive drum 51*a* with the transfer belt 40 therebetween.

In the image forming unit 5, the scanner 52 selectively irradiates a photosensitive drum 51*a* which is uniformly charged by a corresponding charger 51*b*. This irradiation selectively removes electric charges from the photosensitive drum 51*a*, thereby forming an electrostatic latent image on a surface of the photosensitive drum 51*a*.

A developing bias is applied to each developing roller 51*c*. When an electrostatic latent image formed on the photosensitive drum faces a corresponding developing roller 51*c*, the developing roller 51*c* supplies toner to the electrostatic latent image because of the electric potential difference. Consequently, a toner image is formed on the photosensitive drum 51*a*.

A sheet S transported by the transfer belt 40 toward the image forming unit 5 sequentially passes between the transfer belt 40 and the photosensitive drums 51*a*. When each photosensitive drum 51*a* faces the sheet, a toner image on a surface thereof is transferred onto the sheet S because of a transfer bias applied to a corresponding transfer roller 42.

The sheet S with the transferred toner images is transported to the fixer 60. The fixer 60 includes a heat roller 61 for heating the sheet S, and a pressure roller 62 disposed opposite to the heat roller 61. When the sheet S transported to the fixer 60 passes between the heat roller 61 and the pressure roller 62 which are in press-contact with each other, the tonner images are thermally fixed to the sheet S.

The transport unit 7 transports the sheet S with the thermally fixed toner images downstream away from the image forming unit 5. The transport unit 7 includes a first transport unit 71 and a second transport unit 72.

The first transport unit 71 has a function of discharging a sheet S transported from the image forming unit 5 onto the discharge tray 23*a*. The second transport unit 72 has a function of returning a sheet S transported from the image forming unit 5 back to the image forming unit 5.

Instead of returning a sheet S to the image forming unit 5, the second transport unit 72 may have a function of transporting a sheet S transported from the image forming unit 5 toward an optional device disposed above the image forming apparatus 1. For example, an optional device may be a mail box including multiple sheet trays.

In a duplex mode where the image forming apparatus 1 forms images on both sides of a sheet S, the second transport unit 72 inverts and transports a sheet S having an image formed on one side by the image forming unit 5 back to the image forming unit 5. After the image forming unit 5 forms an image on the other side of the sheet S, the first transport unit 71 discharges the sheet S onto the discharge tray 23*a*. As compared with a case where the first transport unit 71 alone discharges and returns sheets S, the second transport unit 72, which is dedicated to return sheets S to the image forming unit 5, allows for the image forming apparatus 1 to transport more sheets per unit time in the duplex mode.

Transport Unit

The transport unit 7 will now be described.

As shown in FIGS. 1-4, the transport unit 7 includes the first transport unit 71, the second transport unit 72, a flap 73, and a middle cover 25.

The first transport unit 71 includes a post-fixing roller pair 710, an intermediate discharge roller pair 711, and a discharge roller pair 712 which are disposed in this order on a downstream side of the fixer 60 in the sheet transport direction to transport a sheet S. The discharge roller pair 712 discharges the sheet S onto the discharge tray 23*a*. The post-fixing roller pair 710 is an example of a transport roller pair which is disposed downstream of an image forming unit in a sheet transport direction to transport a sheet. The post-fixing roller pair 710 is disposed at an upper rear portion of the fixer 60.

The first transport unit 71 defines a main transport path P21 for transporting a sheet S from the fixer 60 to the post-fixing roller pair 710, and a first discharge path P22 for discharging the sheet S guided from the post-fixing roller pair 710 onto the discharge tray 23*a*. A first transport path P2 of the first transport unit 71 includes the main transport path P21 and the first discharge path P22. A sheet S transported from the image forming unit is transported onto the discharge tray 23*a* along the first transport path P2. The main transport path P21 and the first discharge path P22 are each an example of a first transport path.

The main transport path P21 extends obliquely rearward and upward from the fixer 60 to the post-fixing roller pair 710. The first discharge path P22 extends upward from a downstream end of the main transport path P21, and then obliquely frontward and upward toward the discharge tray 23*a*. The intermediate discharge roller pair 711 is disposed in the middle of the first discharge path P22. The discharge roller pair 712 is disposed at a downstream end of the first discharge path P22.

In discharging a sheet S transported from the image forming unit 5 onto the discharge tray 23*a* in the image forming apparatus 1, the post-fixing roller pair 710 transports the sheet S having a toner image thermally fixed by the fixer 60 from the main transport path P21 into the first discharge path P22. Then the intermediate discharge roller pair 711 transports the sheet S along the first discharge path P22, and the discharge roller pair 712 discharges the sheet S onto the discharge tray 23*a*.

The second transport unit 72 defines a return path P3 which is branched from the first transport path P2 and along which a sheet S transported from the image forming unit 5 is transported back toward the image forming unit 5. The return path P3 is an example of a second transport path. The first transport path P2 and the return path P3 branch at a junction Ps. The return path P3 includes a first path P31 for transporting a sheet S transported from the image forming unit 5, and a second path P32 for returning a switched back sheet S toward the image forming unit 5. The first path P31 branches at the junction Ps from the first transport path P2 and extends upward at a position further to the rear of the housing 2 than the first transport path P2. The second path P32 branches from the first path P31 and extends downward. The first path P31 extends to an upper end of the housing 2. The second path P32 branches from the first path P31 to extends downward, and extends frontward to reach the first transport roller pair 34.

The second transport unit 72 includes a first switchback roller pair 721 and a second switchback roller pair 722 which define the first path P31 of the return path P3. The first switchback roller pair 721 is an example of a switchback roller pair disposed at a second cover. The second switchback roller pair 722 is disposed above the first switchback roller pair 721. The first switchback roller pair 721 and the second switchback roller pair 722 are configured to rotate in forward and reverse directions. The first and second switchback roller pairs 721 and 722 transport a sheet S along the first path P31 upward to an exterior of the housing 2 when rotating in the forward direction, and toward an interior of the housing 2 when rotating in the reverse direction.

The flap 73 is disposed at the junction Ps between the first transport path P2 and the return path P3. The flap 73 has, at its end, a first swing shaft or axis 73*a* parallel to the first pivot axis 21*a* and has, at its other end, a swing end portion 73*b*. The swing end portion 73*b* of the flap 73 is swingable about the first swing axis 73*a*. The first swing axis 73*a* is located above the junction Ps and the swing end portion 73*b*.

Figure 3:
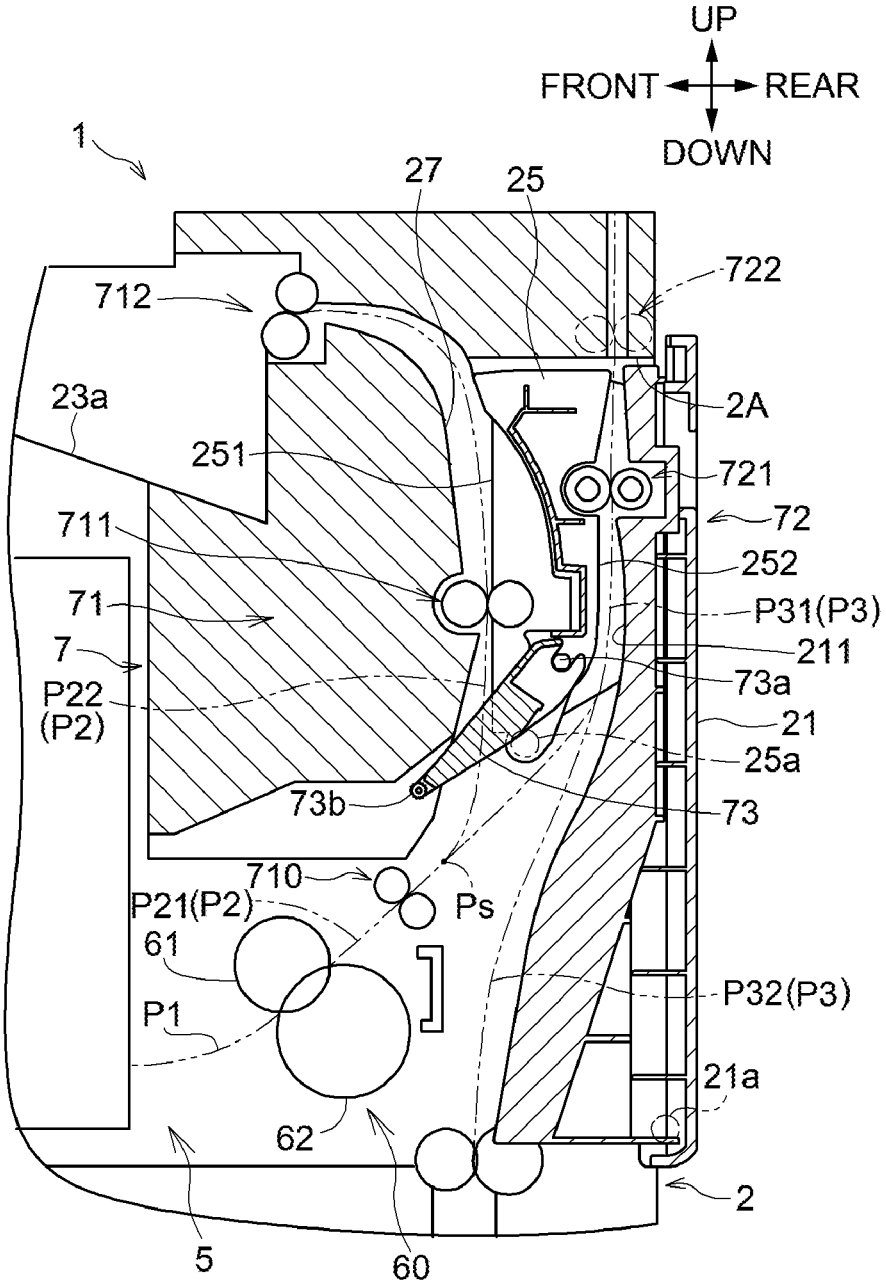
FIG. 3 is a cross-sectional side view of the transport unit, with the rear cover closed and the flap located at a second position.

The flap 73 is configured to swing about the first swing axis 73*a* between a first position (shown in FIG. 2) and a second position (shown in FIG. 3). The flap 73, when located at the first position, guides a sheet S transported from the image forming unit 5 into the first discharge path P22 and blocks the first path P31 of the return path P3 and, when located at the second position, guides the sheet S into the first path P31 and blocks the first discharge path P22. The swing end portion 73*b* is located at an upper position when the flap 73 is at the second position than when the flap 73 is at the first position.

The middle cover 25 extends vertically at a position further to the front of the housing 2 (i.e., farther from the rear end of the housing 2) than the rear cover 21. The middle cover 25 is an example of a second cover. The middle cover 25 has, at its lower end, a second pivot shaft or axis 25*a* parallel to the first pivot axis 21*a*. The middle cover 25 is supported by the housing 2 pivotably about the second pivot axis 25*a*. The second pivot axis 25*a* of the middle cover 25 is located above the first pivot axis 21*a* of the rear cover 21. An upper end of the middle cover 25 is located below an upper end of the rear cover 21. The middle cover 25 is shorter vertically than the rear cover 21. The flap 73 is supported by the middle cover 25 swingably about the first swing axis 73*a*. The first swing axis 73*a* is located above the second pivot axis 25*a* and further to the rear (i.e., closer to the rear end) of the housing 2 than the second pivot axis 25*a*.

The housing 2 has a first guide surface 27 partially defining the first transport path P2 in the first transport unit 71. The middle cover 25 has a second guide surface 251 and a third guide surface 252. The second guide surface 251 is located further to the rear (i.e., closer to the rear end) of the housing 2 than the first guide surface 27 and partially defines the first transport path P2. The third guide surface 252 is located further to the rear (i.e., closer to the rear end) of the housing 2 than the second guide surface 251 and partially defines the return path P3. The rear cover 21 has a fourth guide surface 211 located further to the rear (i.e., closer to the rear end) of the housing 2 than the third guide surface 252 to partially define the return path P3.

The second pivot axis 25*a* of the middle cover 25 is located at a lower end of the middle cover 25. The middle cover 25, when closed, partially defines the first transport path P2 and, when open, exposes the first transport path P2. The middle cover 25 is openable when the rear cover 21 is open. A sheet jam, if occurs, is eliminated readily by opening the middle cover 25 to expose the first transport path P2.

The rear cover 21, when closed, defines at least a portion of the return path P3 and, when open, holds a sheet S transported from the image forming unit 5 to an exterior of the housing 2. When the rear cover 21 is open, the post-fixing roller pair 710 transports the sheet transported from the image forming unit 5 rearward to a position outside of the housing 2. In this case, the sheet S is transported to the rear cover 21 along a second discharge path P4, thereby being discharged straight.

Drive Unit of Flap

Figure 5:
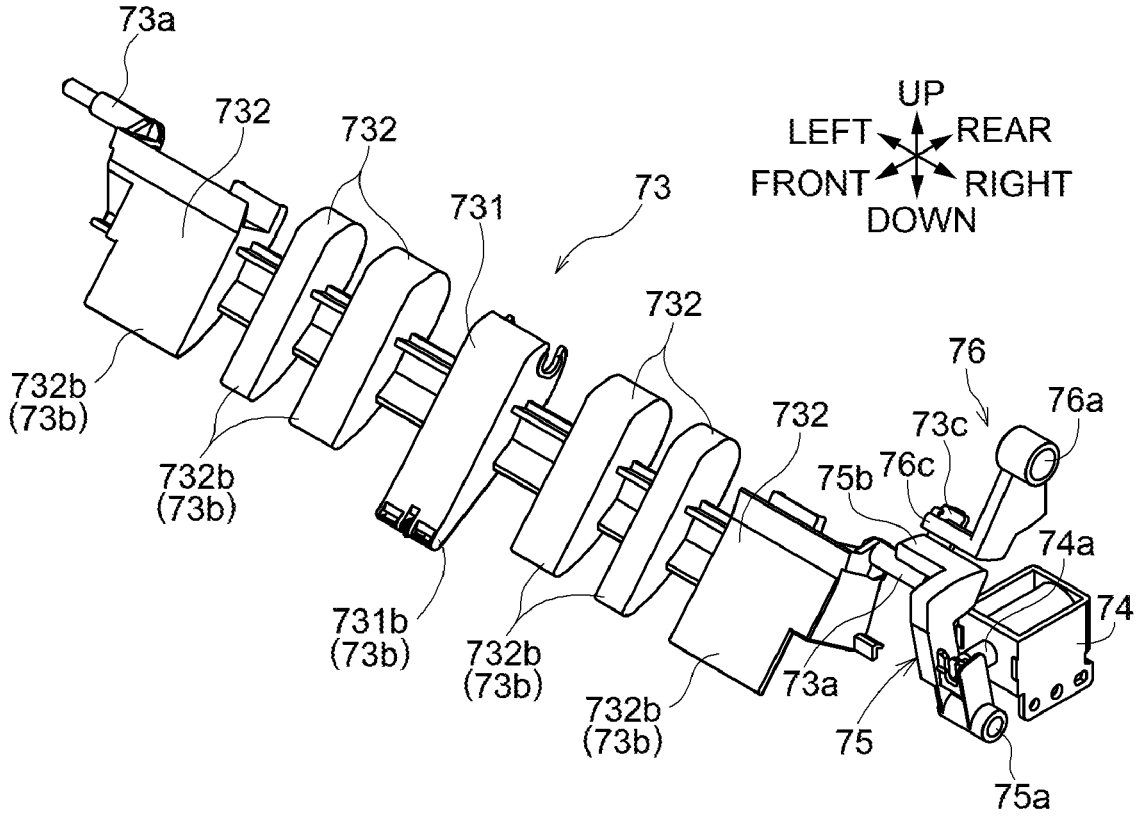
FIG. 5 is a perspective view of the flap.
Figure 6:
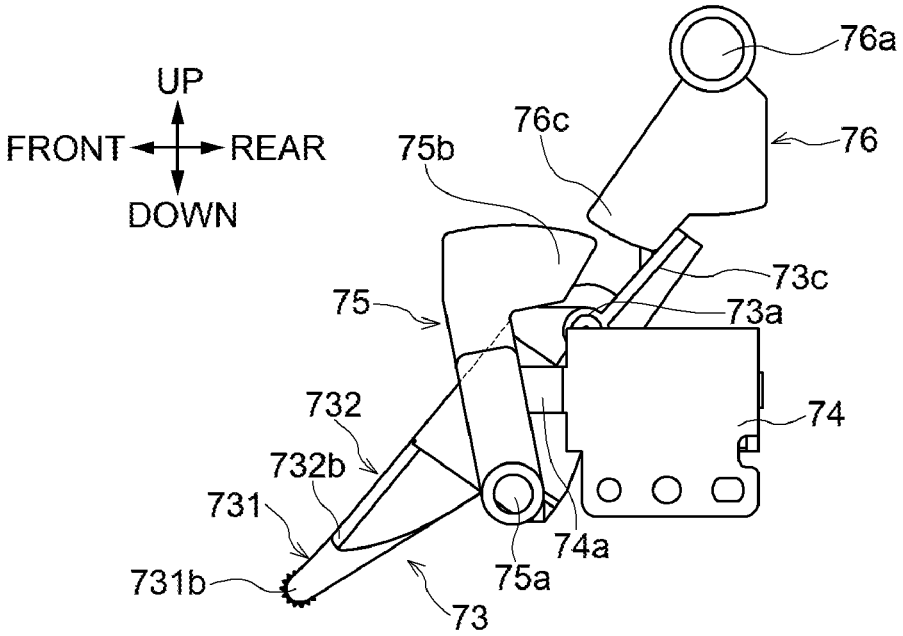
FIG. 6 is a side view of the flap.

As shown in FIGS. 5 and 6, the flap 73 includes, at its right end, an operation lever 73*c* extending rearward. The flap 73 is configured to swing to the first position by its own weight in a free state where no force is applied to the operation lever 73*c* in a pivoting direction.

The flap 73 includes a first flap member 731 disposed at a central position in a width direction orthogonal to the sheet transport direction, and second flap members 732 disposed at positions closer to the widthwise ends than the first flap member 731. A plurality of second flap members 732 are disposed on the left and right sides of the first flap member 731. When viewed in an axial direction of the first swing axis 73*a*, the length of each second flap member 732 from the first swing axis 73*a* to a swing end 732*b* is less than the length of the first flap member 731 from the first swing axis 73*a* to a swing end 731*b*. The swing end 732*b* of each second flap member 732 is located above the swing end 731*b* of the first flap member 731.

The image forming apparatus 1 includes an electromagnetic solenoid 74 for driving the flap 73, and a drive lever 75 connected to the electromagnetic solenoid 74 so as to contact and swing the flap 73. The electromagnetic solenoid 74 is an example of a drive unit configure to move the flap 73 between the first position and the second position. The electromagnetic solenoid 74 and the drive lever 75 are supported by the housing 2.

The electromagnetic solenoid 74 includes an extendable plunger 74*a* connected to the drive lever 75. The drive lever 75 includes, at its one end, a third swing shaft or axis 75*a* and, at its other end, a contact portion 75*b* contactable with the operation lever 73*a*. When the drive lever 75 swings about the third swing axis 75*a*, the contact portion 75*b* is movable between a spaced position at which the contact portion 75*b* is spaced from the operation lever 73*c*, and a contact position at which the contact portion 75*b* contacts the operation lever 73*c* and pushes the operation lever 73*c* in the pivoting direction.

The plunger 74*a* extends when the electromagnetic solenoid 74 is not excited, and retracts when the electromagnetic solenoid 74 is excited. The drive lever 75 moves to the spaced position when the plunger 74*a* extends, and moves to the contact position when the plunger 74*a* retracts.

Figure 7A:
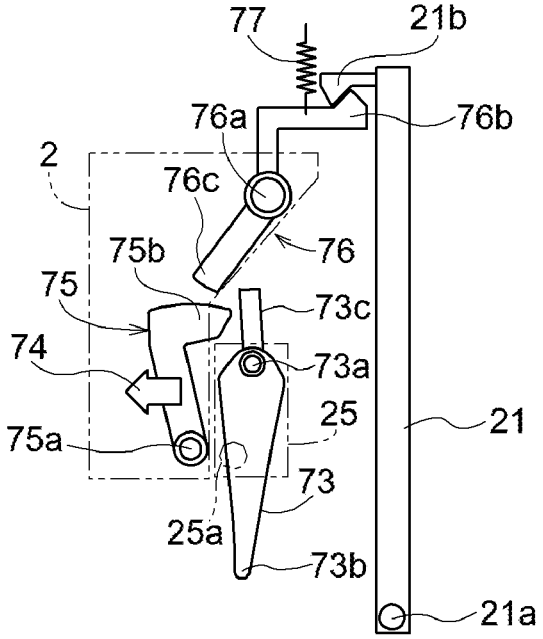
FIG. 7A is a schematic side view of the flap not driven by an electromagnetic solenoid.
Figure 7B:
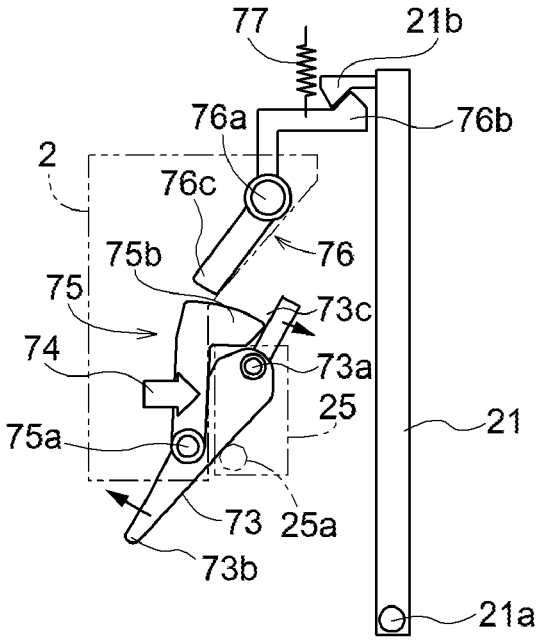
FIG. 7B is a schematic side view of the flap driven by the electromagnetic solenoid.

As shown in FIG. 7A, when the electromagnetic solenoid 74 is not excited, the drive lever 75 moves to the spaced position such that the contact portion 75*b* moves away from the operation lever 73*c*. This makes the flap 73 into a free state, thereby allowing the flap 73 to swing to the first position by its own weight. On the other hand, as shown in FIG. 7B, when the electromagnetic solenoid 74 is excited, the drive lever 75 moves to the contact position 75*b* such that the contact portion 75*b* pushes the operation lever 73*c* in the pivoting direction. Thus, the flap 73 swings from the first position to the second position. The electromagnetic solenoid 74 is configured to, when not excited, switch the flap 73 into the first position and, when excited, switch the flap 73 into the second position.

In order for the image forming unit 5 to guide a sheet S into the first discharge path P22, a controller of the image forming apparatus 1 switches the electromagnetic solenoid 74 into an unexcited state to cause the flap 73 to swing to the first position and block the first path P31 of the return path P3. In order for the image forming unit 5 to guide a sheet S into the first path P31 of the return path P3, the controller switches the electromagnetic solenoid 74 into an excited state to cause the flap 73 to swing to the second position and block the first discharge path P22.

In the image forming apparatus 1, a time period for transporting a sheet S along the first transport path P2 with the flap 73 located at the first position is likely to be longer than a time period for transporting a sheet S along the return path P3 with the flap 73 located at the second position. Thus, the flap 73 is configured to be located at the first position when the electromagnetic solenoid 74 is not excited. This may reduce a time period during which the electromagnetic solenoid 74 is excited, resulting in energy saving.

Flap Moving Mechanism

A moving mechanism for moving the flap 73 between the first position and the second position in response to opening and closing of the rear cover 21 will be described. The moving mechanism is configured to move away from the flap 73 when the rear cover 21 is closed, and push and move the flap 73 to the second position when the rear cover 21 is opened.

As shown in FIGS. 5-7, the moving mechanism includes a moving lever 76 swingably supported by the housing 2, and an urging spring 77 configured to urge the moving lever 76. In FIGS. 7 and 8, the housing 2, middle cover 25, moving lever 76, and flap 73 are shown schematically but have the same effects as those shown in this embodiment. The moving lever 76 includes a second swing shaft or axis 76*a* parallel to the first swing axis 73*a*, one end 76*b* engageable with an engaged member 21*b*, and the other end 76*c* configured to push the flap 73. The one end 76*b* and the other end 76*c* are opposite to each other relative to the second swing axis 76*a*. The urging spring 77 urges the moving lever 76 in such a direction that the one end 76*b* engages the engaged member 21*b*. The moving lever 76 is an example of a lever swingably supported by a housing 2, and the urging spring 77 is an example of an urging member.

As shown in FIGS. 7A and 7B, in a state where the rear cover 21 is closed, the one end 76*b* of the moving lever 76 engaged with the engaged member 21 restricts the rear cover 21 from pivoting to be opened, thereby maintaining the rear cover 21 closed. The one end 76*b* of the moving lever 76 is urged about the second swing axis 76*a* in a counterclockwise direction by the urging spring 77. This prevents the one end 76*b* of the moving lever 76 from being easily released from the engaged member 21*b*.

In a state where the one end 76*b* of the moving lever 76 is engaged with the engaged portion 21*b*, the other end 76*c* of the moving lever 76 is restricted from swinging toward the operation lever 73*c* and is spaced from the operation lever 73*c*. In a state where the other end 76*c* of the moving lever 76 is spaced from the operation lever 73*c*, the flap 73 is inoperable by the moving lever 76 but switchable by the electromagnetic solenoid 74 between the first position and the second position.

Figure 8A:
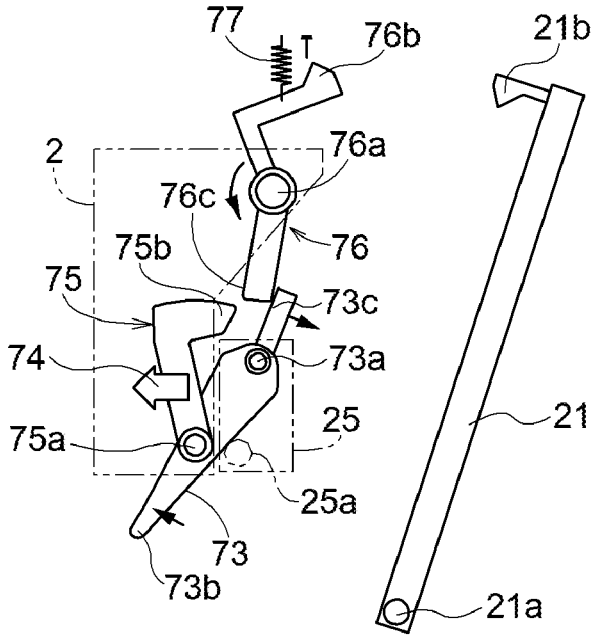
FIG. 8A is a schematic side view of the flap driven by a moving mechanism when a middle cover is opened.

In contrast, as shown in FIG. 8A, when the rear cover 21 is pivoted open from a closed state, the one end 76*b* of the moving lever 76 is released from the engaged portion 21*b* of the rear cover 21. Upon release of the one end 76*b* from the engaged portion 21*b*, the moving lever 76 swings, by an urging force of the urging spring 77, about the second swing axis 76*a* in the counterclockwise direction such that the other end 76*c* moves toward the operation lever 73*c*. The other end 76*c* pushes the operation lever 73*c* of the flap 73 located at the first position, thereby moving the flap 33 to the second position.

As described above, when the rear cover 21 is closed, the other end 76*c* of the moving lever 76 of the moving mechanism is spaced from the operation lever 73*c*, and when the rear cover 21 is open, the other end 76*c* is urged by the urging spring 77 to push the flap 73 to the second position. When the rear cover 21 is opened, the one end 76*b* of the moving lever 76 is released from the rear cover 21. The moving lever 76 is urged by the urging spring 77 to move the flap 73 to the second position.

When a sheet S is discharged straight to an exterior of the housing 2 with the rear cover 21 open, the flap 73 located at the second position allows the sheet S to be transported properly to the exterior of the housing 2 while blocking the first transport path P2 to prevent the sheet S from entering the first transport path P2.

Opening the rear cover 21 causes the moving mechanism to move the flap 73 to the second position. This may obviate the need for exciting the electromagnetic solenoid 74, resulting in energy saving.

Figure 4:
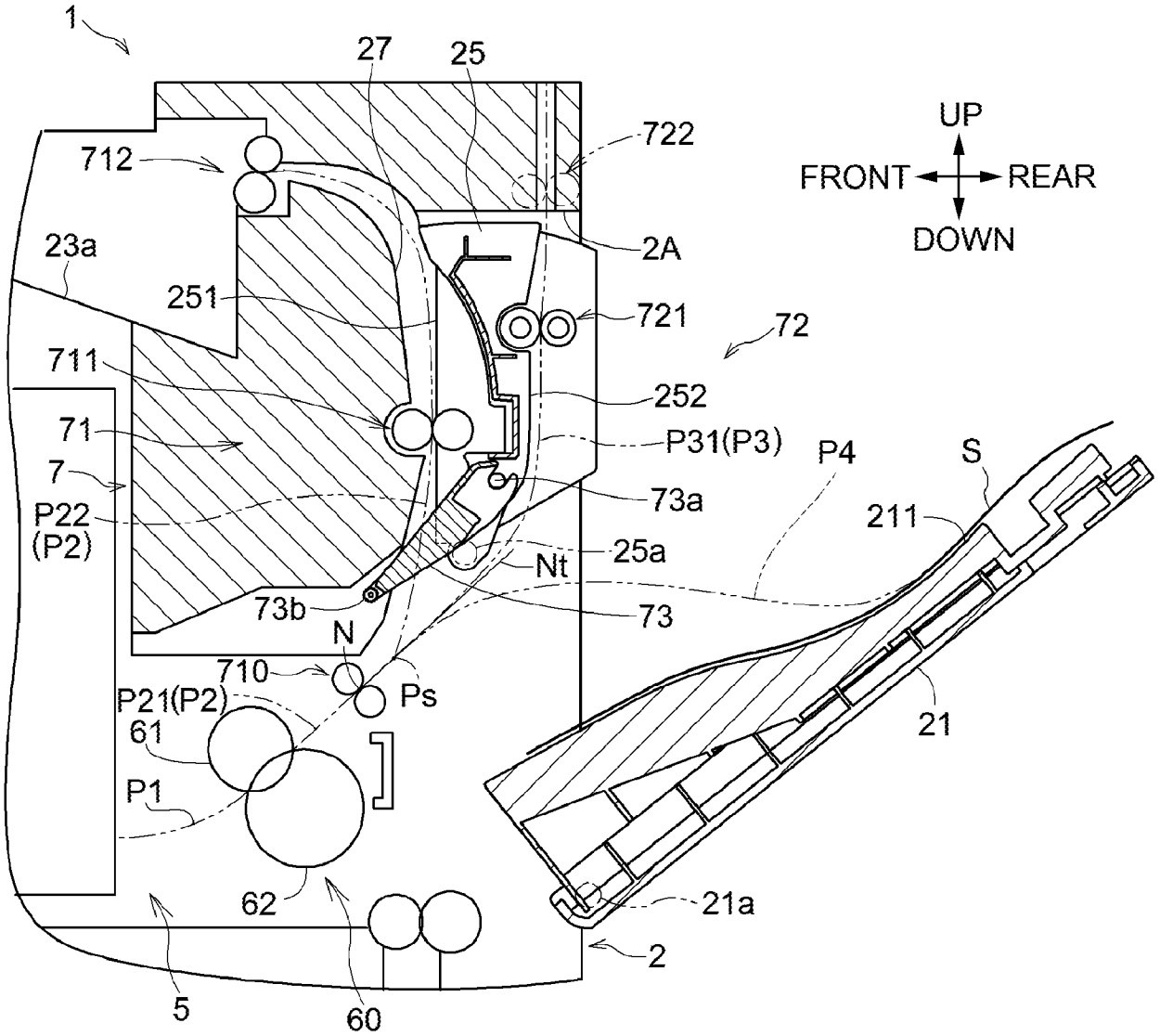
FIG. 4 is s cross-sectional side view of the transport unit, with the rear cover open and the flap located at the second position.

As shown in FIG. 4, when the rear cover 21 is opened, the swing end portion 73*b* of the flap 73 having moved to the second position is located on an upper side of a tangent Nt to the nip N between the post-fixing roller pair 710. In other words, the swing end portion 73*b* of the flap 73 at the second position is located opposite to the open first cover 21 relative to the tangent Nt.

When a sheet S is discharged straight to the exterior of the housing 2 with the rear cover 21 open, the sheet S is unlikely to pass through a position on the upper side of the tangent Nt. Thus, the swing end portion 73*b* of the flap 73, which blocks, at the second position, the first transport path P2, is located on the upper side of the tangent Nt, thereby reliably preventing entry of the sheet S into the first transport path P2.

If the image forming apparatus 1 is not provided with the post-fixing roller pair 710, entry of a sheet S into the first transport path P2 may be prevented by positioning the swing end portion 73*b* of the flap 73 on an upper side of a tangent to a nip between the heat roller 61 and the pressure roller 62.

Figure 8B:
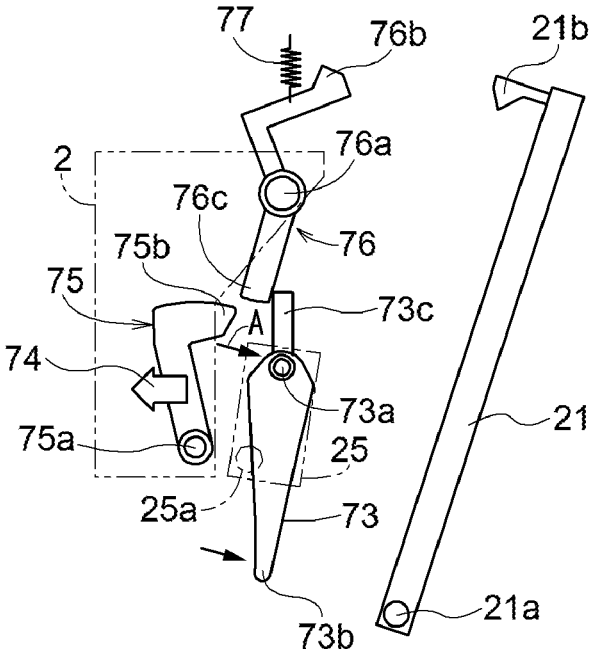
FIG. 8B is a schematic side view of the flap moving away from a movable lever when the middle cover is opened.

As shown in FIG. 8B, the flap 73 is swingably supported by the middle cover 25. When the middle cover 25 is opened with the rear cover 21 open and with the flap 73 located at the second position, the first swing axis 73*a* moves, about the second pivot axis 25*a*, from a position shown in FIG. 8A to a position shown in FIG. 8B in a direction of arrow A.

Figure 9:
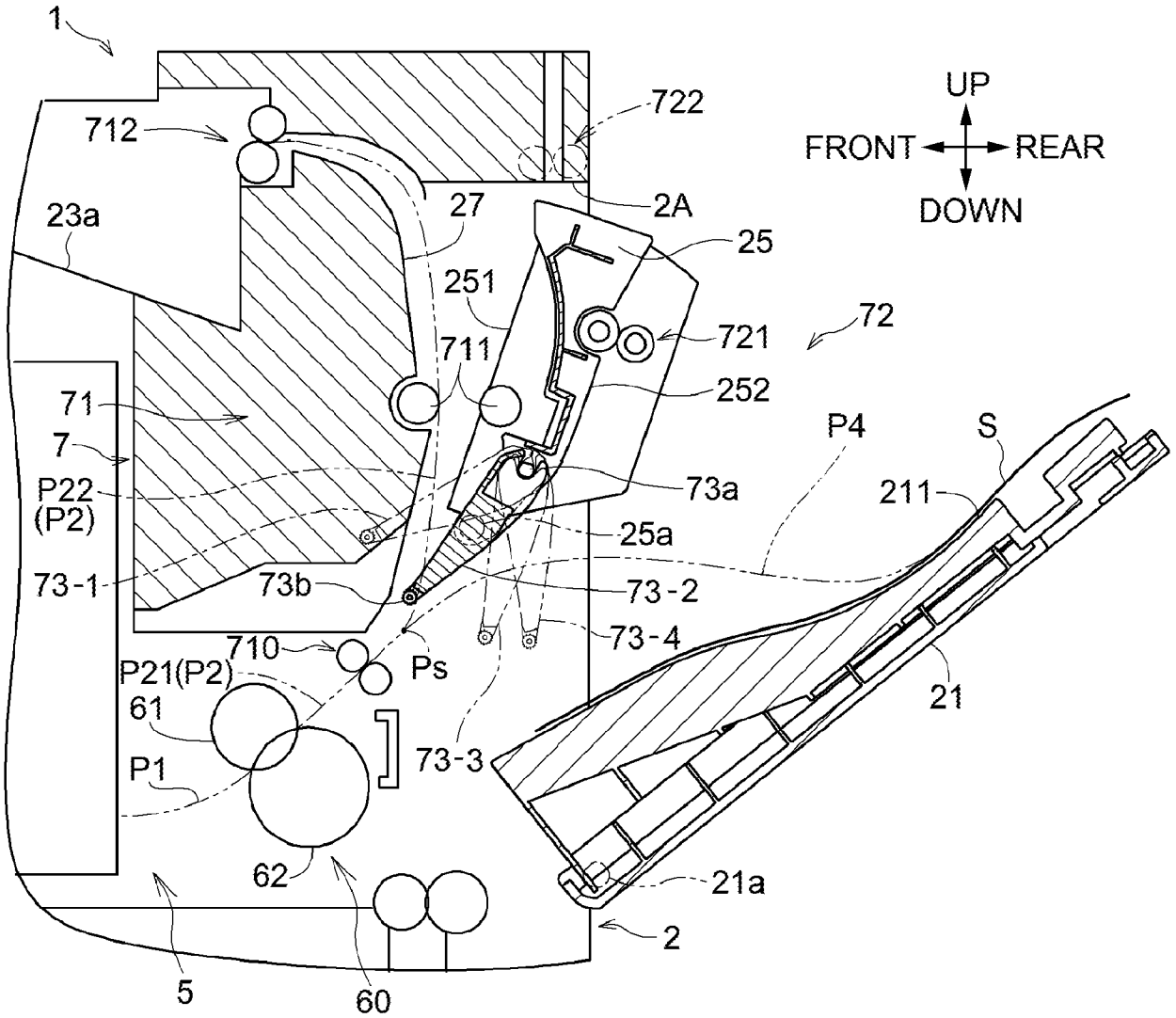
FIG. 9 is s cross-sectional side view of the transport unit, with the flap having moved to a third position away from the movable lever in response to opening of the middle cover.

In response to such movement of the first swing axis 73*a*, the operation lever 73*c* swings about the first swing axis 73*a* in the counterclockwise direction while contacting the other end 76*c* of the moving lever 76. The swing end portion 73*b* swings about the first swing axis 73*a* in the counterclockwise direction. As shown in FIG. 9, as a result of opening the middle cover 25, the flap 73 moves to a third position such that the swing end portion 73*b* is located between the first position and the second position, thereby blocking the first transport path P2. The first position and the second position described herein refers to positions of the flap 73 relative to the middle cover 25.

The flap 73-2 shown by a solid line in FIG. 9 corresponds in position to the flap 73 shown in FIG. 8B. Although FIG. 9 shows the middle cover 25 which is open, the flap 73-3 at the first position shown by a two-dot chain line in FIG. 9 indicates a position of the flap 73 relative to the middle cover 25 which is closed. Similarly, the flap 73-1 at the second position shown by a two-dot chain line in FIG. 9 indicates a position of the flap 73 relative to the middle cover 25 which is closed.

When the middle cover 25 is further opened from a state shown in FIG. 9, the swing end portion 73*b* of the flap 73 swings about the first swing axis 73*a* further in the counterclockwise direction. Ultimately, the operation lever 73*c* is released from the other end 76*c* of the moving lever 76, and the swing end portion 73*b* swings further in the counterclockwise direction such that the flap 73 moves rearward from the first position of the flap 73-3 to a position of the flap 73 shown by a two-dot chain line.

As described above, in a state where the middle cover 25 is open, the flap 73 blocks the first transport path P2 with the swing end portion 73*b* located between the first position and the second position. When in this state, a sheet S is discharged straight to an exterior of the housing 2, and the flap 73 may prevent the sheet S from entering the first transport path P2.

Unlike in this embodiment, if the flap 73 is configured to, when the middle cover 25 is opened, pivot while being retained at the second position, the flap 73 located at the second position (refer to the flap 73-1 in FIG. 9) pivots in a direction to further block the first transport path P2. In this case, if the middle cover 25 is opened to remove any sheet S jammed in the first transport path P2, a remaining sheet S may be pushed by the flap 73 and hard to remove.

In this embodiment, however, when the middle cover 25 is opened, the flap 73 swings about the first swing axis 73*a* in the counterclockwise direction. The swing end portion 73*b* swings about the first swing axis 73*a* in the counterclockwise direction (toward the rear end of the housing 2) away from the first transport path P2. The flap 73 thus structured may facilitate removal of a sheet S remaining in the first transport path P2 without pushing the remaining sheet S.

The first swing axis 73*a* of the flap 73 is located further to the rear (i.e., closer to the rear end) of the housing 2 than the second pivot axis 25*a* of the middle cover 25. Unlike in this embodiment, if the first swing axis 73*a* is located further to the front (i.e., farther from the rear end) of the housing 2 than the second pivot axis 25*a*, opening the middle cover 25 causes the first swing axis 73*a* to move from an inner (front) position to an outer (rear) position across the second pivot axis 25*a*. This may increase a moving range of the flap 73.

In this embodiment, however, the first swing axis 73*a* is located further to the rear (i.e., closer to the rear end) of the housing 2 than the second pivot axis 25*a*. When the middle cover 25 is opened, the first swing axis 73*a* is always at a position further to the rear of the housing 2 than the second pivot axis 25*a*, without moving across the second pivot axis 25*a*. This may reduce a moving range of the flap 73, resulting in downsizing of the image forming apparatus 1.

Block Member

The first switchback roller pair 721 of the second transport unit 72 is supported by the middle cover 21 so as to remain in the housing 2 when the rear cover 21 is opened to expose the return path P3 (refer to FIG. 4).

Figure 10:
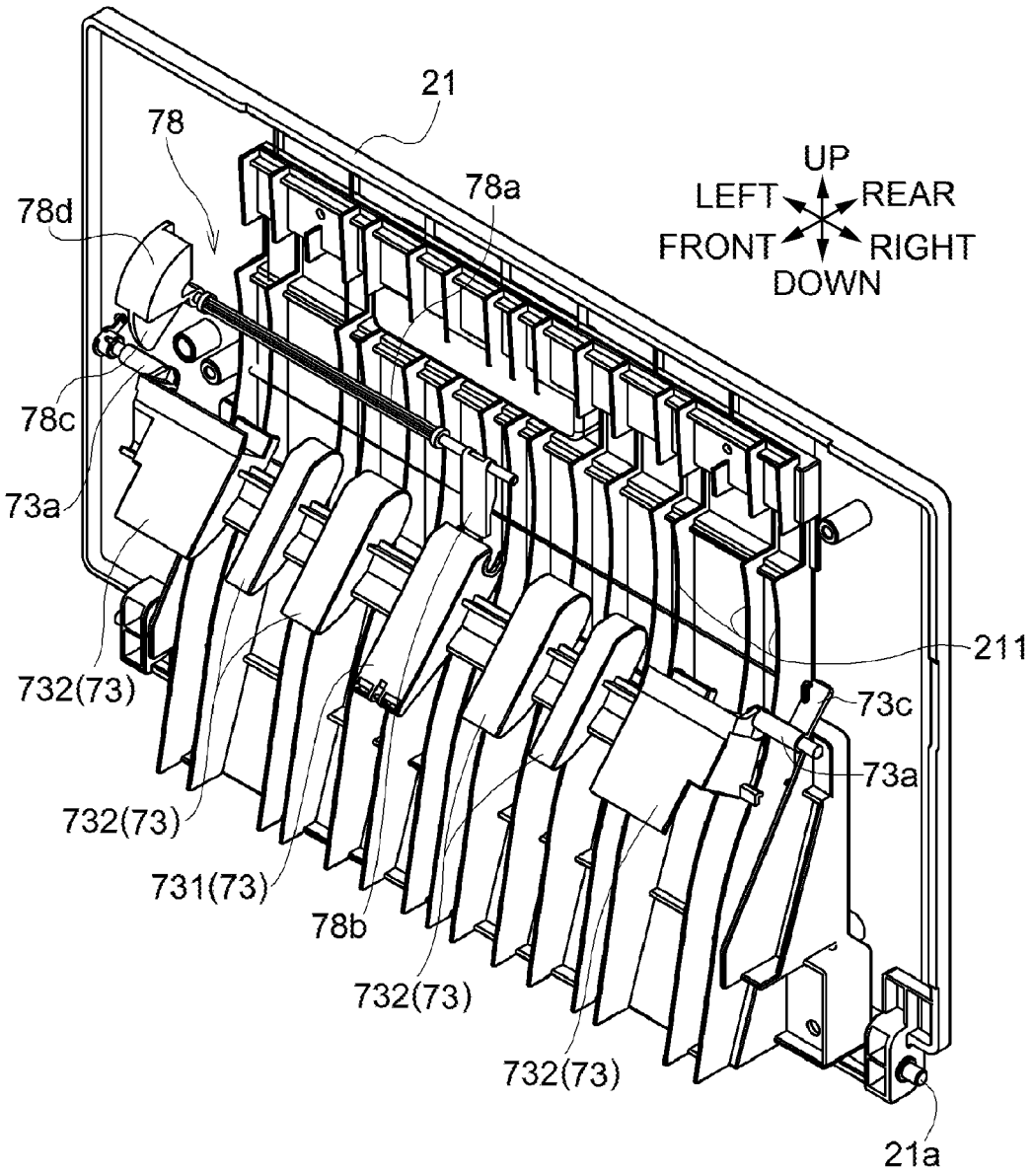
FIG. 10 is a perspective view of a block member disposed at the transport unit.

As shown in FIG. 10, the image forming apparatus 1 includes a block member 78 configured to retract from the return path P3 when the rear cover 21 is closed and to enter the return path P3 when the rear cover 21 is opened. The block member 78 is disposed upstream of the first switchback roller pair 721 in the return path P3.

The block member 78 includes a third swing shaft or axis 78*a* parallel to the first swing axis 73*a*, a block piece 78*b* disposed at one end of the third swing shaft 78*a*, and a contact piece 78*c* and a weight portion 78*d* which are disposed at the other end of the third swing shaft 78*a*. The one end with the block piece 78*b* is located at a central position in the left-right direction. The third swing shaft 78*a* is supported by the housing 2. The block piece 78*b*, the contact piece 78*c*, and the weight portion 78*d* are integrally swingable about the third swing shaft or axis 78*a*. The block piece 78*b* is disposed above the first flap portion 731.

The block piece 78*b* is configured to swing about the third swing axis 78*a*, between a retracted position to be retracted from the return path P3, and an advanced position to block the return path P3. When the rear cover 21 is closed, the contact piece 78*c* contacts the rear cover 21 and is restricted from swinging about the third swing axis 78*a*. When the rear cover 21 is open, the contact piece 78*c* is released from the rear cover 21 and swingable about the third swing axis 78*a*.

The weight portion 78*d* is heavier than the block piece 78*b* and the contact piece 78*c*. When not restricted from swinging about the third swing axis 78*a*, the weight portion 78*d* swings, by its own weight, to a lower position below the third swing axis 78*a*. When the contact piece 78*c* is in contact with the rear cover 21 to thereby restrict the weight portion 78*d* from swinging about the third swing axis 78*a*, the weight portion 78*d* is maintained, against its own weight, at an upper position above the third swing axis 78*a*. The block piece 78*b* moves to the retracted position in response to the weight portion 78*d* moving to the upper position, and moves to the advanced position in response to the weight portion 78*d* moving to the lower position.

The block member 78 thus structured operates as described below. As shown in FIG. 11A, in a state where the rear cover 21 is closed, the contact piece 78*c* is in contact with the rear cover 21 to be restricted from swinging about the third swing axis 78*a*, and the weight portion 78*d* is maintained at the upper position. In this state, the block piece 78*b* is located at the retracted position and retracted from the return path P3.

When the rear cover 21 is closed, the block piece 78*b* is retracted from the return path P3. In this state, the flap 73 is located at the first position and blocks the return path P3, and thus a sheet S is unlikely to enter the return path P3.

Figure 11B:
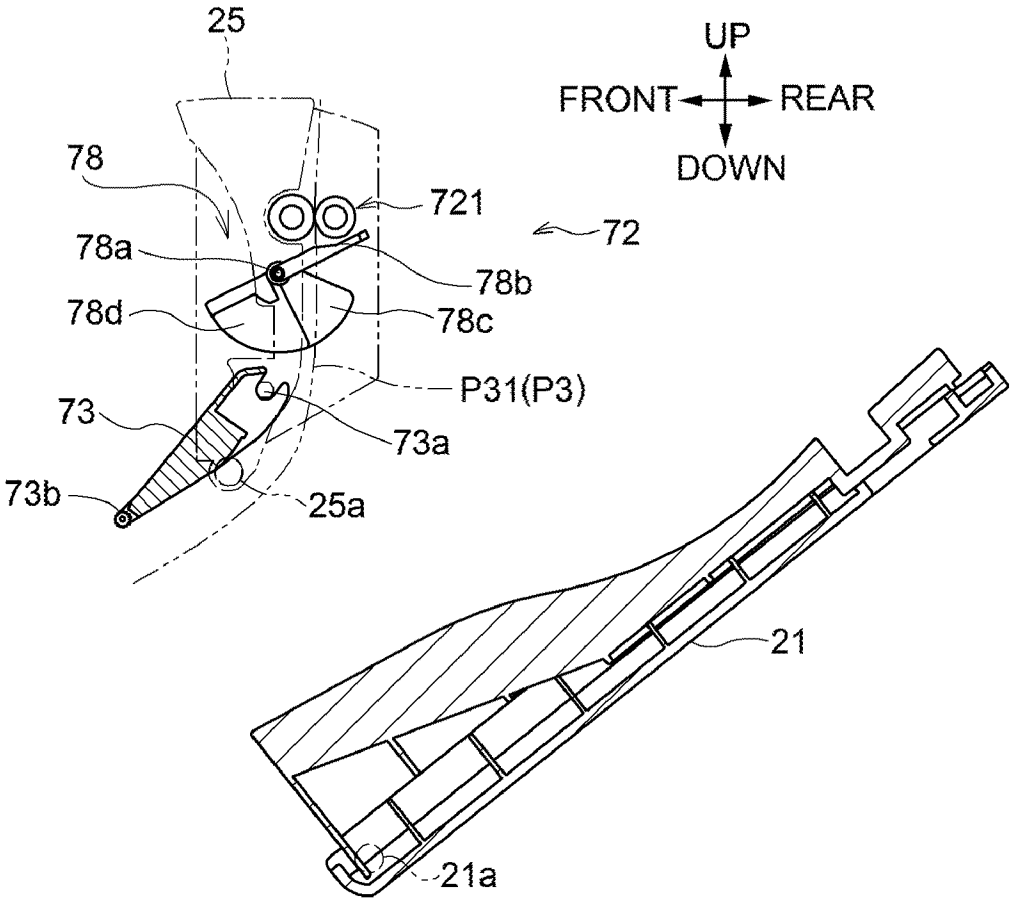
FIG. 11B is a cross-sectional side view of the block member with a block piece at an advanced position to block the return path.
Figure 11A:
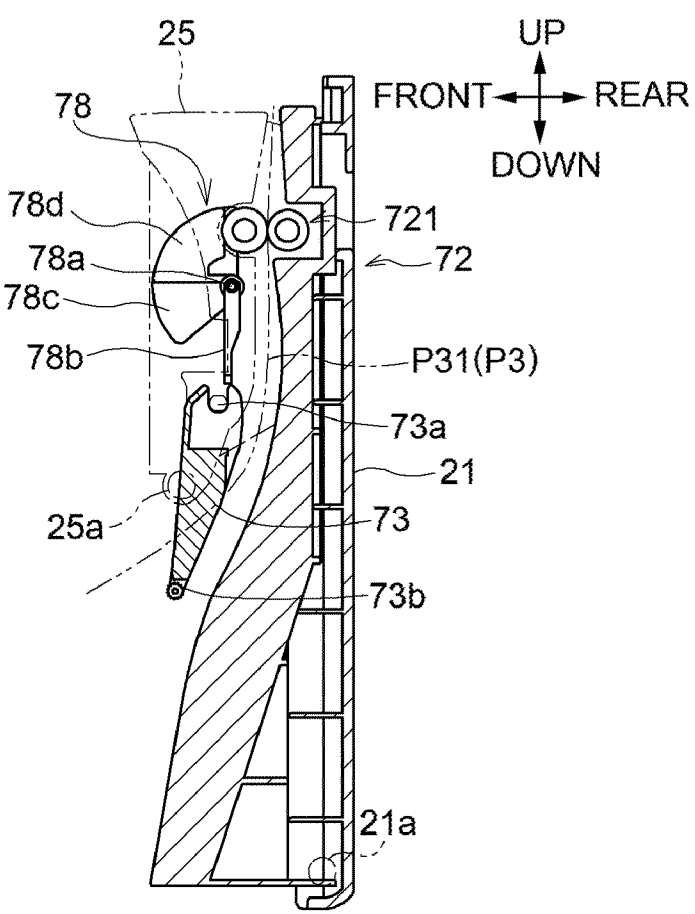
FIG. 11A is a cross-sectional side view of the block member with a block piece at a position retracted from a return path.

In contrast, as shown in FIG. 11B, when the closed rear cover 21 is opened, the contact piece 78*c* is released from the rear cover 21 to be swingable about the third swing axis 78*a*. In this case, the weight portion 78*d* swings by its own weight to the lower position, and the block piece 78*b* moves to the advanced position. The block piece 78*b* having moved to the advanced position blocks the return path P3.

In a state where the rear cover 21 is open, the flap 73 is located, by the moving mechanism, at the second position and does not block the return path P3. In this state, the block piece 78*b* is located upstream of the first switchback roller pair 721 in the return path P3 and blocks the return path P3 to prevent a sheet S from entering further downstream than the block piece 78*b*. Even if the first switchback roller pair 721 is configured to rotate when a sheet S is discharged straight, the block piece 78*b* prevents transport of a sheet S by the first switchback roller pair 721.

If a sheet S is discharged straight to an exterior of the housing 2 with the rear cover 21 open in the image forming apparatus 1 without the block member 78, a sheet S transported from the image forming unit 5 may enter the return path P3 and be transported by the first switchback roller pair 721 located in the return path P3. However, in this embodiment, the block member 78 is provided such that the block piece 78*b* blocks the return path P3 when the rear cover 21 is open. This prevents or reduces entry of a sheet S into the return path P3 and prevents transport of a sheet S by the first switchback roller pair 721.

While the disclosure has been described in detail with reference to particular examples, various changes, arrangements and modifications may be applied therein without departing from the spirit and scope of the disclosure.

What is claimed is:

1. An image forming apparatus comprising:

an image forming unit configured to form an image on a sheet;

a housing storing therein the image forming unit and including a discharge tray at an upper portion thereof, the housing having a particular end;

a first transport unit configured to transport, along a first transport path, the sheet transported from the image forming unit to the discharge tray;

a second transport unit configured to transport, along a second transport path, the sheet transported from the image forming unit, the second transport path being branched from a junction with the first transport path and extending upward at a position closer to the particular end of the housing than the first transport path;

a first cover disposed at the particular end of the housing pivotably relative to the housing and configured to, when closed, at least partially constitute the second transport unit and, when open, hold the sheet transported from the image forming unit to an exterior of the housing;

a flap disposed at the junction swingably between a first position and a second position, the flap being configured to:

when at the first position, block the second transport path and guide, along the first transport path, the sheet transported from the image forming unit, and when at the second position, block the first transport path and guide, along the second transport path, the sheet transported from the image forming unit;

a drive unit configured to move the flap between the first position and the second position; and a moving mechanism configured to, in response to closing of the first cover, move away from the flap and, in response to opening of the first cover, push and move the flap to the second position.

2. The image forming apparatus according to claim 1, further comprising a transport roller pair disposed downstream of the image forming unit in a sheet transport direction and configured to transport the sheet, wherein the flap has, at one end thereof, a first swing axis and, at the other end thereof, a swing end portion swingable about the first swing axis, and the swing end portion of the flap having moved to the second position in response to opening of the first cover is located opposite to the first cover relative to a tangent to a nip between the transport roller pair.

3. The image forming apparatus according to claim 1, further comprising a second cover pivotably supported in the housing at a position farther from the particular end of the housing than the first cover, wherein the housing has a first guide surface partially constituting the first transport unit, wherein the second cover has a second guide surface located closer to the particular end of the housing than the first guide surface and partially constituting the first transport unit, and a third guide surface located closer to the particular end of the housing than the second guide surface and partially constituting the second transport unit, wherein the first cover has a fourth guide surface located closer to the particular end of the housing than the third guide surface and partially constituting the second transport unit, and wherein the second cover has a pivot axis at a lower end thereof and is configured to, when closed, partially constitute the first transport unit and, when open, expose the first transport unit.

4. The image forming apparatus according to claim 3, wherein the moving mechanism includes:

a lever supported by the housing swingably about a second swing axis, the lever having one end engageable with the first cover, and the other end opposite to the one end relative to the second swing axis; and an urging member configured to urge the lever in such a direction that the one end of the lever engages the first cover in response to closing of the first cover, wherein the moving mechanism is configured such that, in response to closing of the first cover, the other end of the lever moves away from the flap and, in response to opening of the first cover, the other end of the lever is urged by the urging member to swing and push the flap to the second position.

5. The image forming apparatus according to claim 4, wherein the flap is swingably supported by the second cover and is configured to, in response to opening of the second cover, move to a position closer to the particular end of the housing than the second position.

6. The image forming apparatus according to claim 5, wherein the flap is configured to, in response to opening of the second cover, move to a position between the first position and the second position.

7. The image forming apparatus according to claim 5, wherein the flap is configured to, in response to opening of the second cover, move to a third position which is between the first position and the second position and at which the flap blocks the first transport path.

8. The image forming apparatus according to claim 5, wherein the flap is configured to, in response to opening of the second cover, move to a position closer to the particular end of the housing than the first position.

9. The image forming apparatus according to claim 3, wherein the first swing axis of the flap is located closer to the particular end of the housing than the pivot axis of the second cover.

10. The image forming apparatus according to claim 1, wherein the drive unit includes an electromagnetic solenoid configured to, when unexcited, switch the flap to the first position and, when excited, switch the flap to the second position.

11. The image forming apparatus according to claim 3, further comprising a block member configured to, in response to closing of the first cover, retract from the second transport path to a retract position by contacting the first over and, in response to opening of the first cover, move to an advanced position to enter and block the second transport path, wherein the second cover includes a switchback roller pair configured to reverse a direction of the sheet.

12. The image forming apparatus of claim 1, wherein the image comprises a first image, and the image forming apparatus is configured to form the first image on a first side of the sheet, and wherein the second transport path is configured to return the sheet to the image forming unit to form an image on a second side of the sheet that is opposite the first side.

13. An image forming apparatus comprising:

an image forming unit configured to form a first image on a first side of a sheet;

a housing storing therein the image forming unit and including a discharge tray at an upper portion thereof, the housing having a particular end;

a first transport unit configured to transport, along a first transport path, the sheet transported from the image forming unit to the discharge tray;

a second transport unit configured to transport, along a second transport path, the sheet transported from the image forming unit, the second transport path being branched from a junction with the first transport path and configured to return the sheet to the image forming unit to form a second image on a second side of the sheet that is opposite the first side of the sheet;

a first cover disposed at the particular end of the housing pivotably relative to the housing and configured to, when closed, at least partially constitute the second transport unit and, when open, hold the sheet transported from the image forming unit to an exterior of the housing;

a flap disposed at the junction swingably between a first position and a second position, the flap being configured to:

when at the first position, block the second transport path and guide, along the first transport path, the sheet transported from the image forming unit, and when at the second position, block the first transport path and guide, along the second transport path, the sheet transported from the image forming unit;

a drive unit configured to move the flap between the first position and the second position; and a moving mechanism configured to, in response to closing of the first cover, move away from the flap and, in response to opening of the first cover, push and move the flap to the second position.

14. The image forming apparatus according to claim 13, further comprising a transport roller pair disposed downstream of the image forming unit in a sheet transport direction and configured to transport the sheet, wherein the flap has, at one end thereof, a first swing axis and, at the other end thereof, a swing end portion swingable about the first swing axis, and the swing end portion of the flap having moved to the second position in response to opening of the first cover is located opposite to the first cover relative to a tangent to a nip between the transport roller pair.

15. The image forming apparatus according to claim 13, further comprising a second cover pivotably supported in the housing at a position farther from the particular end of the housing than the first cover, wherein the housing has a first guide surface partially constituting the first transport unit, wherein the second cover has a second guide surface located closer to the particular end of the housing than the first guide surface and partially constituting the first transport unit, and a third guide surface located closer to the particular end of the housing than the second guide surface and partially constituting the second transport unit, wherein the first cover has a fourth guide surface located closer to the particular end of the housing than the third guide surface and partially constituting the second transport unit, and wherein the second cover has a pivot axis at a lower end thereof and is configured to, when closed, partially constitute the first transport unit and, when open, expose the first transport unit.

16. The image forming apparatus according to claim 15, wherein the moving mechanism includes:

a lever supported by the housing swingably about a second swing axis, the lever having one end engageable with the first cover, and the other end opposite to the one end relative to the second swing axis; and an urging member configured to urge the lever in such a direction that the one end of the lever engages the first cover in response to closing of the first cover, wherein the moving mechanism is configured such that, in response to closing of the first cover, the other end of the lever moves away from the flap and, in response to opening of the first cover, the other end of the lever is urged by the urging member to swing and push the flap to the second position.

17. The image forming apparatus according to claim 16, wherein the flap is swingably supported by the second cover and is configured to, in response to opening of the second cover, move to a position closer to the particular end of the housing than the second position.

18. The image forming apparatus according to claim 17, wherein the flap is configured to, in response to opening of the second cover, move to a position between the first position and the second position.

19. The image forming apparatus according to claim 17, wherein the flap is configured to, in response to opening of the second cover, move to a third position which is between the first position and the second position and at which the flap blocks the first transport path.

20. The image forming apparatus according to claim 17, wherein the flap is configured to, in response to opening of the second cover, move to a position closer to the particular end of the housing than the first position.

* * * * *